United States Patent [19]

Perry

[11] 4,015,842

[45] Apr. 5, 1977

[54] BILL STACKER

[75] Inventor: George J. Perry, Sudbury, Mass.

[73] Assignee: NCR Corporation, Dayton, Ohio

[22] Filed: Nov. 20, 1975

[21] Appl. No.: 633,995

[52] U.S. Cl. ..... 271/185; 271/207; 271/224; 214/6 N

[51] Int. Cl.[2] ..... B65H 33/06

[58] Field of Search ..... 271/64, 173, 184, 185, 271/207, 220, 223, 224, 4; 214/6 N; 198/235; 270/58

[56] References Cited

UNITED STATES PATENTS

| | | | |
|---|---|---|---|
| 2,114,927 | 4/1938 | Krell | 271/207 X |
| 2,901,249 | 8/1959 | Dexter et al. | 270/58 |
| 3,860,127 | 1/1975 | Fassman | 214/6 N |
| 3,946,879 | 3/1976 | Jensen | 214/6 N |

*Primary Examiner*—Robert W. Saifer

*Attorney, Agent, or Firm*—J. T. Cavender; Albert L. Sessler, Jr.; Elmer Wargo

[57] ABSTRACT

An apparatus and method for automatically stacking bills (like paper currency) in a container, generally cruciform in shape in cross section, and defining first and second intersecting rectangular compartments therein. The bills are singly fed in a feed plane in a chute towards an opening in the container with the length of the bills in the chute being positioned perpendicular to a common axis of the container. A selector with first and second legs depending therefrom is shifted between first and second positions so as to alternately position the first and second legs in the feed plane causing successive bills being fed to be rotated in the feed plane and fed alternately into the first and second compartments.

7 Claims, 6 Drawing Figures

BILL STACKER

BACKGROUND OF THE INVENTION

This invention relates to an apparatus and method for automatically stacking bills, like paper currency, in a specially-shaped container for use in dispensing machines like cash dispensing machines.

In recent times there has been increased interest in developing and using cash dispensing machines, which among providing other financial transactions, provide for the dispensing of cash in conjunction with a "credit card" inserted in the machines. U.S. Pat. 3,710,976 discloses one such machine which dispenses bills or paper currency.

The dispensing machine shown in said patent utilizes a specially-shaped container for storing, loading, and dispensing currency from the machine.

The present invention relates to an apparatus and method for automatically stacking bills in a container of the type disclosed in said patent.

SUMMARY OF THE INVENTION

This invention relates to an apparatus and method for automatically stacking bills in a specially-shaped container means having first and second compartments therein, with said first and second compartments intersecting each other. The apparatus includes feed means for feeding a bill along a feed plane towards an opening in the container means and selector means moveable between first and second positions. When the selector means is in the first position, a first abutment member thereof is positioned in the feed plane causing the leading edge of an approaching bill to abut thereagainst and to rotate the bill in a first direction in said feed plane and to enter into the first compartment. When the selector means is in the second position, a second abutment member is positioned in the feed plane, causing the leading edge of the next successive bill to abut thereagainst and to rotate the bill in a second direction in said feed plane and to enter into the second compartment. The selector means is alternately shifted between the first and second positions thereby causing successive bills to be alternately stacked in the first and second compartments. This apparatus and method provide an accurate, inexpensive means for automatically stacking bills in a container of the type described in said patent.

BRIEF DESCRIPTION OF THE DRAWINGS

Other advantages and features of this invention may be more readily obtained from a reading of the following description and drawings in which.

DETAILED DESCRIPTION OF THE INVENTION

Figure 1:
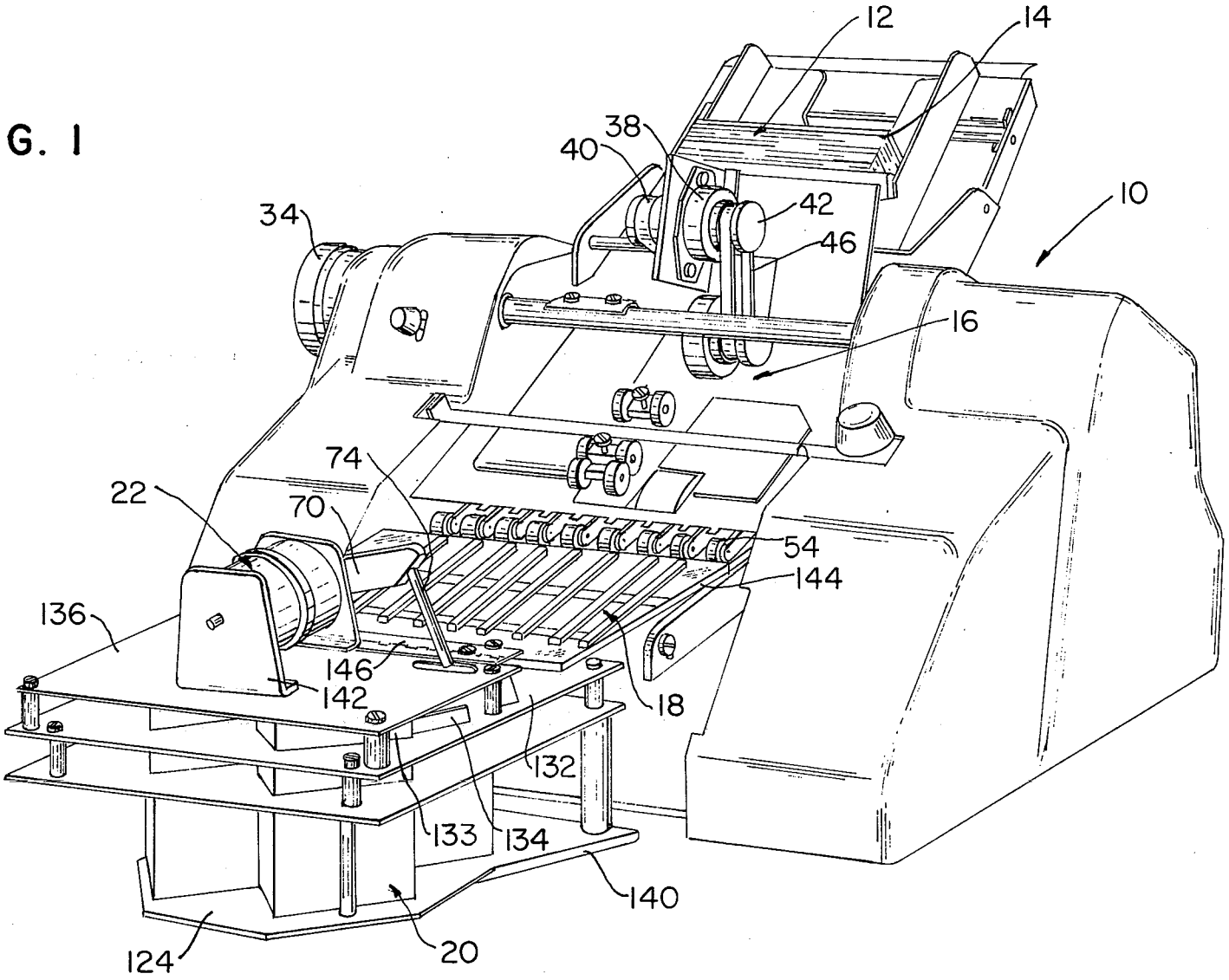
FIG. 1 is a front perspective view of a bill stacker embodying the principles of this invention, showing a hopper means for storing bills to be stacked, a feed means for extracting bills from the hopper means, a container means for receiving the bills which are to be stacked therein, and a selector means for causing the bills being fed to the container means to be stacked into first and second compartments thereof.

FIG. 1 shows a bill stacker 10 which embodies the principles of this invention. The bill stacker 10 includes a magazine or hopper means 12 having bills 14, like paper currency, stored therein, a feed means 16 for extracting a single bill from the hopper means 12, a chute means 18 for guiding the extracted bill in a feed plane; a container means 20 for receiving the bills to be stacked, and a selector means 22 for alternately stacking the bills in first 24 and second 26 compartments (FIG. 5) of the container means 20.

Figure 2:
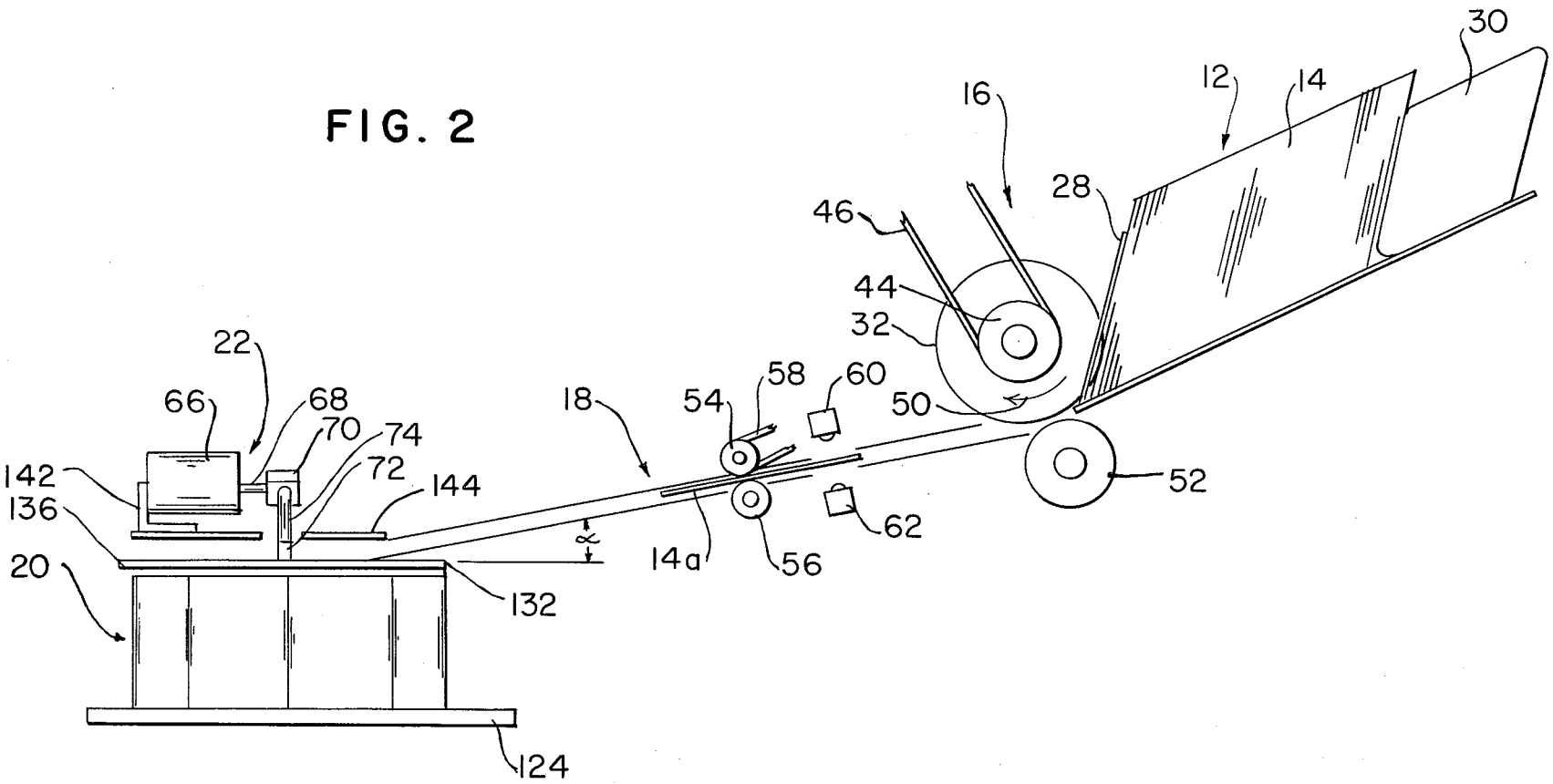
FIG. 2 is a schematic view of the hopper means, feed means, selector means, and container means to show additional details of their general relationship to one another.
Figure 6:
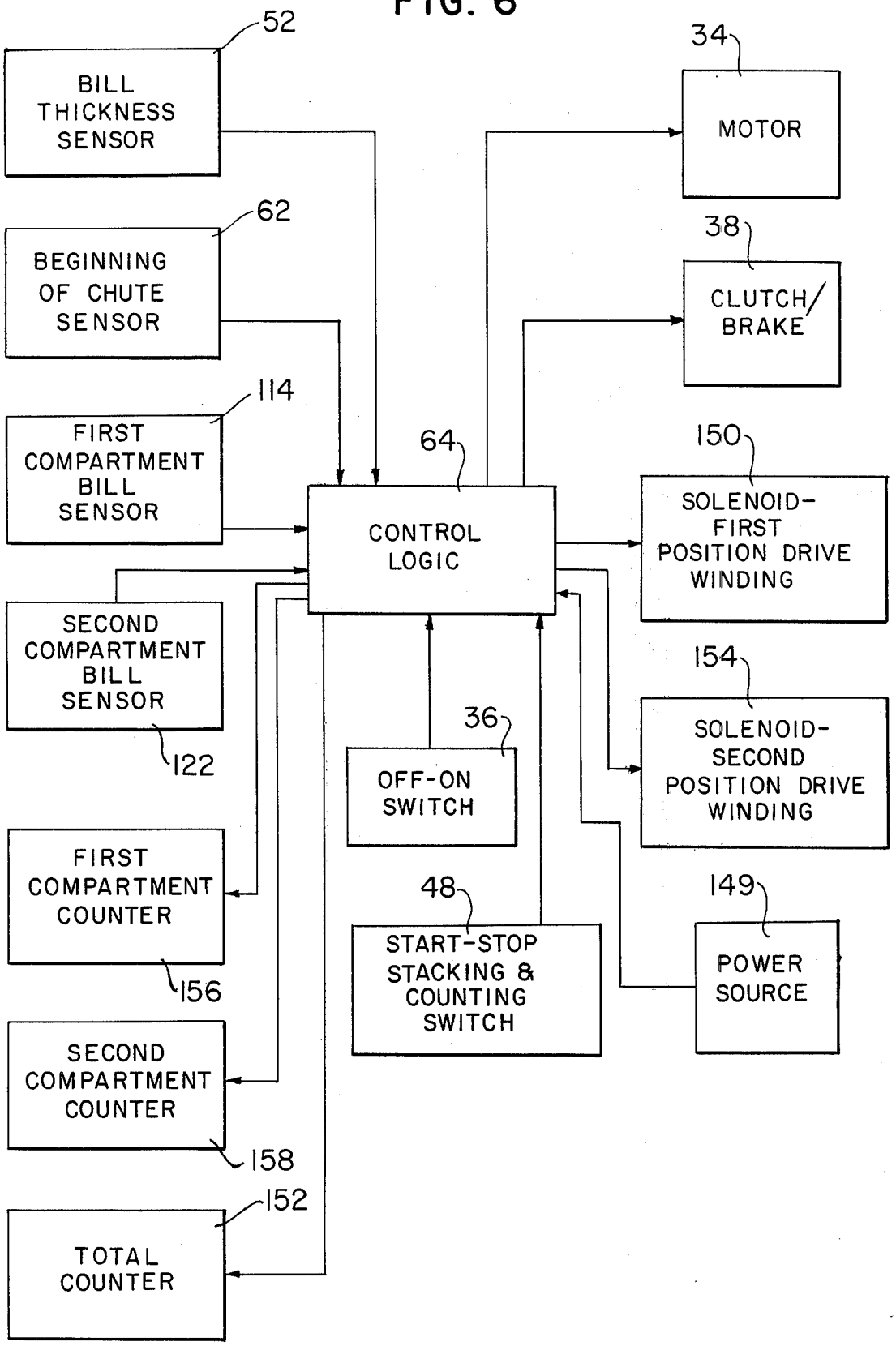
FIG. 6 is a general circuit diagram, in block form, showing a control means for the bill stacker.

As best seen in FIG. 2, the bills 14 are stacked on edge and are gravity fed (by a weight 30) against a slotted abutment plate 28, where a plurality of spaced, serrated, feed wheels 32 of the feed means 16 are used to extract or feed one bill at a time into the chute means 18. The feed means 16 also includes a motor 34 (FIG. 1) which is turned on by a switch 36 (FIG. 6). As the motor 34 rotates, it rotates the input side of a conventional electromagnetic clutch/brake 38 (FIG. 1) via a belt 40; however, the output pulley 42 thereof remains in the braked or stationary condition until the clutch/brake 38 is energized. The output pulley 42 is drivingly connected via a belt 46 to a pulley 44 (FIG. 2) fixed to the feed wheels 32. Whenever the bills 14 are to be fed and stacked, a switch 48 (FIG. 6) is actuated causing the clutch/brake 38 to be energized to rotate its output pulley 42 and thereby rotate the feed wheels 32 in the direction of arrow 50 (FIG. 2). As the feed wheels 32 rotate in the direction shown in FIG. 2, they engage the bill 14 which is adjacent to the slotted plate 28 and force it between the feed wheels 32 and a conventional thickness sensor 52 which permits only one bill to pass therebetween. If more than one bill is detected at the sensor 52, the bill stacker 10 will be shut off until the "jam" or double thickness of bills is corrected. As a bill like **14*a* leaves the feed wheels 32 (to a point about two inches therefrom), it interrupts a beam of light from a light source 60 to an associated switch or light sensor 62, which through conventional control logic 64 (FIG. 6), places the clutch/brake 38 in the brake mode to prevent additional bills 14 from being fed from the hopper means 12 until certain conditions (to be later described herein) are met. After a single bill (like 14*a* in FIG. 2) is extracted by the feed wheels 32, it is fed in a feed plane in the chute means 18 by a plurality of pairs of rollers like drive roller 54 and idler roller 56 with only one pair of such rollers being shown in FIG. 2. The roller 54 is operatively connected to the motor 34 by a belt 58**.

The bill **14*a* (FIG. 2) which was just fed into the chute means 18 by the feed means 16 continues to travel in the feed plane represented by the chute means 18 until it approaches the selector means 22**.

Figure 4:
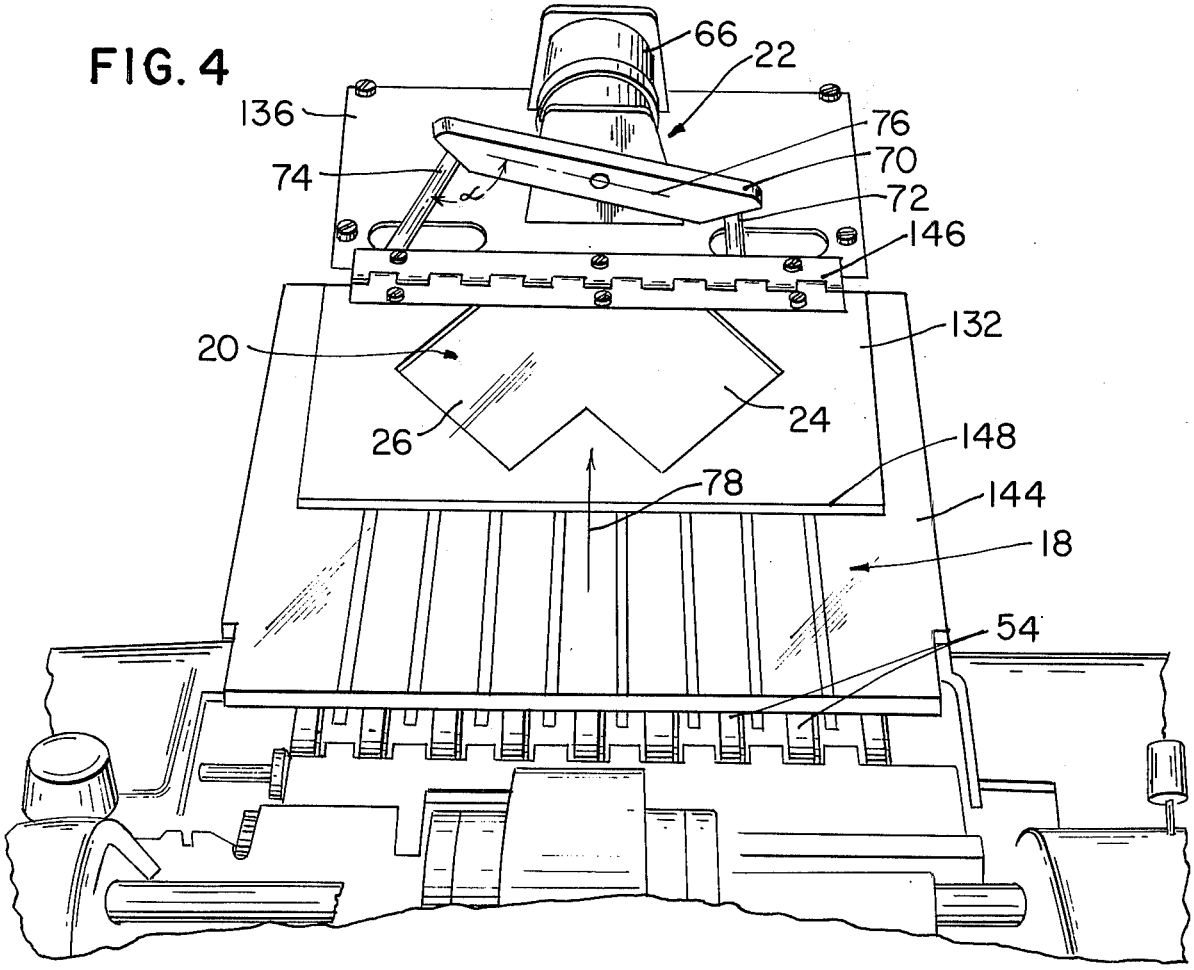
FIG. 4 is a general view in perspective while looking at a beam of the selector means which is pivoted in one of two positions.

The selector means 22 (best shown in FIG. 4) includes a conventional, bi-directional, rotary solenoid 66 having an output shaft 68 (FIG. 2) fixedly connected to the midpoint of a beam 70 having first and second legs 72 and 74 respectively depending from opposed sides thereof as is best shown in FIG. 4. In the embodiment shown, the solenoid 66 can be rotated through an angle of 30° in either direction, and each leg 72, 74 depends from the long axis 76 of the beam 70 at an angle $\alpha$ equal to approximately 120°. The beam 70 and the first and second legs 72, 74 are arranged so that only one of these legs at a time can be positioned in the feed plane or path of an approaching bill like 14*a*.

Figure 5:
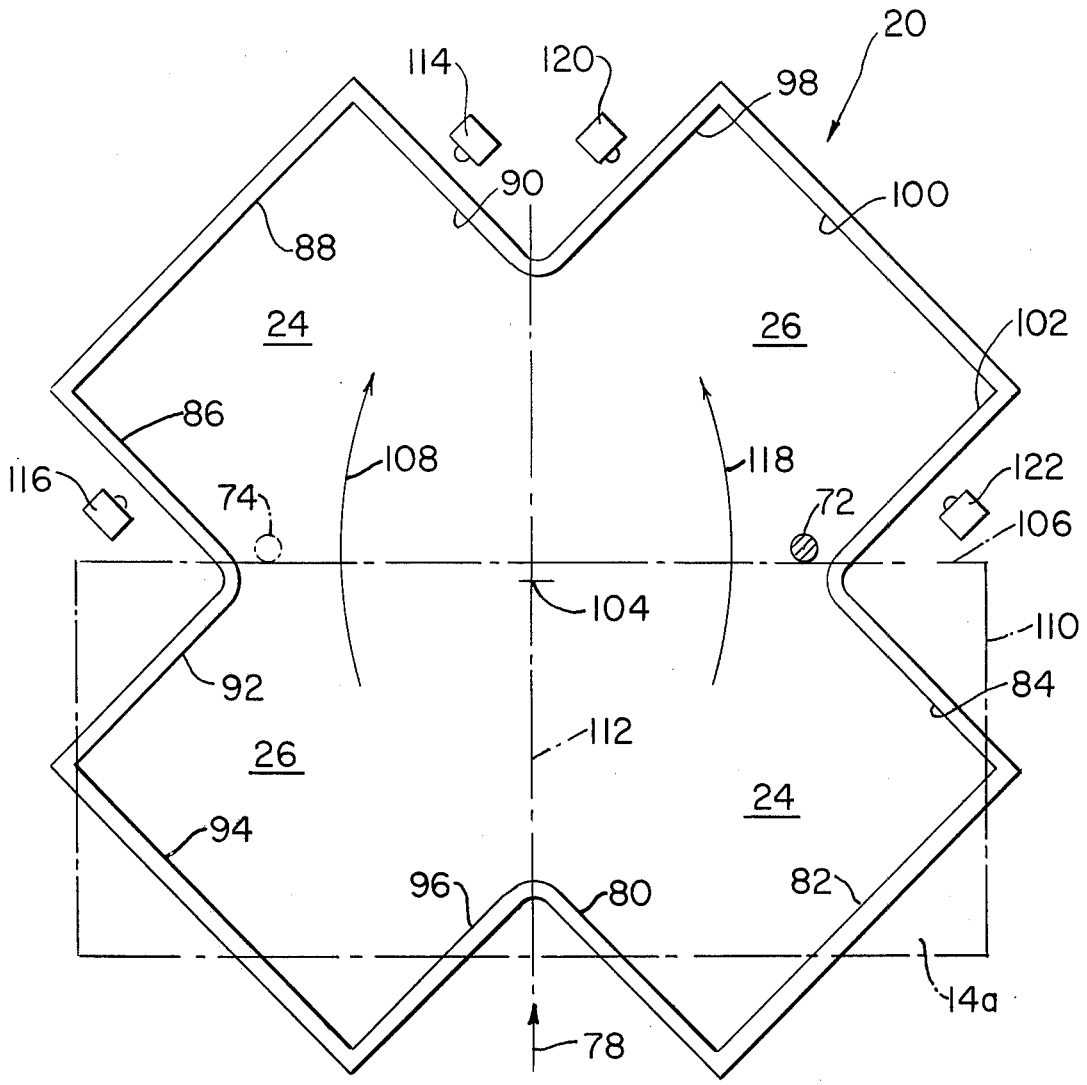
FIG. 5 is a schematic view, looking down into the first and second compartments of the container means, to show the general method of alternately stacking bills in the first and second compartments.

The method by which an approaching bill is stacked in the first or second compartments 24, 26, respectively, of the container means 20 is best shown in FIG. 5. The chute means 18 is arranged and dimensioned to guide a bill like 14*a* along the direction of arrow 78 so that the long dimension of the bill is perpendicular to the arrow 78, and the chute means is positioned at an angle $\alpha$ (FIG. 2) of about 10 degrees relative to the top of the container means 20 for the embodiment shown. The first and second compartments 24 and 26, respectively, of the container means 20 are positioned at a predetermined angular relationship to each other, which for the preferred embodiment shown is 90°. The first compartment 24 is formed by vertical walls 80, 82, 84, 86, 88 and 90, and the second compartment 26 is formed by vertical walls 92, 94, 96, 98, 100, and 102 as is best shown in FIG. 5. The first and second compartments 24 and 26 have a common portion surrounding the vertical axis 104 in the center of the container means 20.

As a bill like 14*a*, in FIG. 5, approaches the selector means 22, (shown in FIG. 4) when in a first position with the first leg 72 thereof being positioned in the feed plane, the leading edge 106 of the bill 14*a* (shown in dashed outline in FIG. 5) will strike the first leg 72 causing the bill 14*a* to pivot about the first leg 72 in the feed plane in the direction of arrow 108, until the leading edge 106 abuts against the wall 90 of the first compartment 24. The first leg 72 is positioned about one-fifth of the length of the bill 14*a* from a side edge 110 thereof towards the center 112 of the bill and is aligned tangentially to the plane formed by the walls 84 and 90 of the first compartment 24. A first switch or light sensor 114 is positioned near the top of the first compartment 24 and cooperates with an associated light source 116 to record the presence of a bill like 14*a* entering the first compartment 24, and the output of the first sensor 114 is fed into the control logic 64 (FIG. 6). After the leading edge 106 of the bill 14*a* abuts against the wall 90, it falls down by gravity to the bottom of the first compartment 24. The walls of the first and second compartments 24, 26 are tapered slightly (not shown) so as to be wider at the top and narrower at the bottom to facilitate the stacking of the bills 14 therein.

After the first bill 14*a* is detected as being in the first compartment 24 by the sensor 114, the control logic 64 causes the selector means 22 to shift to the second position in which the second leg 74 (shown in dashed outlined in FIG. 5) is positioned in the path of the next bill 14*b* (not shown) to enter the container means 20. Control logic 64 also causes the clutch/brake 38 to be energized, causing the next bill to be fed into the chute means 18, etc. As the leading edge of the second bill contacts the second leg 74, the bill will rotate about the second leg 74 in the direction of arrow 118 until the leading edge thereof contacts the wall 98 of the second compartment 26, and falls down by gravity into the second compartment 26 as previously described in relation to the first compartment 24. The second leg 74 is aligned tangentially to the plane formed by the walls 92 and 98 of the second compartment 26. The second compartment 26 also has a light switch or sensor 120 and a light source 122 associated therewith to record the presence of a bill entering the second compartment 26. The output of the light sensor 120 is connected to the control logic 64 which causes the selector means 22 to be shifted to the first position to repeat the stacking process just described. It should be noted that successive bills 14 being fed to the container means 20 are alternately deposited in the first and second compartments 24, 26 thereof, with the selector means being alternately positioned in the first position or the second position so that only one of the legs 72, 74, at a time, is positioned in the path of a bill like 14*a* being fed to the container means 20. The legs 72, 74 each have a plastic sleeve thereon to dampen slightly the impact of the leading edge 106 of a bill 14 hitting thereagainst and also to provide an increase in contact area between the respective leg and the leading edge of a bill. Each bill 14 placed in the container means 20 is displaced at 90° in the embodiment shown relative to the preceding bill; however, each bill has a portion thereof which is stacked on a portion of the preceding bill at the vertical axis 104 of the container means 20.

Figure 3:
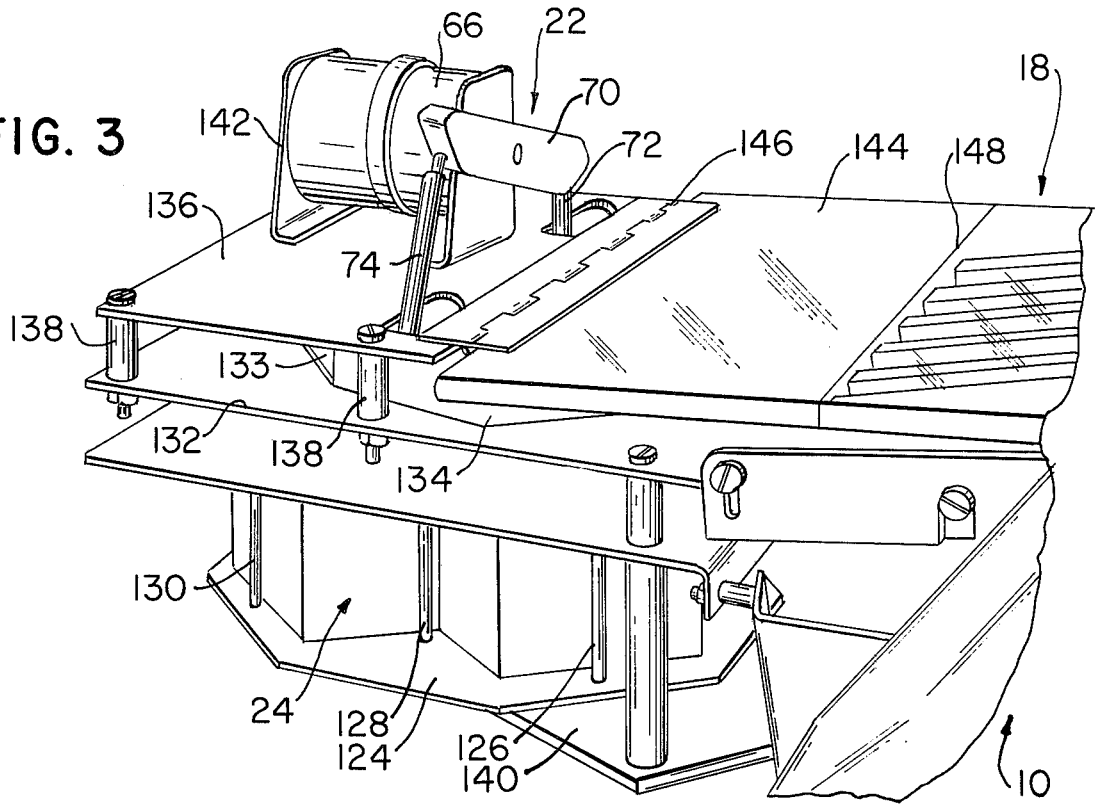
FIG. 3 is a general view, in perspective, of the right side of the bill stacker showing additional details of the selector means and container means.

The container means 20 is conventionally, detachably positioned in the bill stacker 10 on a plate 124 via locating pins like 126, 128 and 130, as is best shown in FIG. 3. The container means 20 is also positioned under a top plate 132 which has a flange 133 and an opening 134 therein which has a shape similar to the shape of the top of the container means 20 shown in FIG. 5, to facilitate the flow of bills 14 into the first and second compartments 24 and 26 thereof. A supporting plate 136 is spaced from the top plate 132 by spacers 138, and the plates 132 and 136 are conventionally secured to bill stacker 10 by a supporting structure 140. The supporting plate 136 supports the rotary solenoid 66 via a flange 142 and also supports (via a hinge 146) a transparent plate 144 which is part of the chute means 18. The plate 144 is separated from the chute means 18 at a line 148 (FIG. 3) to enable the plate 144 to be pivoted on the hinge 146 to gain access to the container means 20 in the area of the selector means 22, should that become necessary or desirable.

The operation of the bill stacker 10, under the control of the control logic 64 shown in FIG. 5, is as follows. When the off-on switch 36 is turned on, a power source 149 supplys all the necessary power and voltage levels to operate the bill stacker 10, as is conventionally done. With switch 36 on, the motor 34 begins to rotate, and the rotary solenoid 66 has its first winding 150 energized to place the selector means 22 in the first position in which the first leg 72 is positioned in the path of a bill 14*a* which is to enter the container means 20. At this time, the clutch/brake 38 is in the braked position and its output pulley 42 is not rotating. To start the stacking operation, the switch 48 is energized.

When the switch 48 (FIG. 6) is energized, the clutch/brake 38 is released, permitting the motor 34 to drive the output pulley 42 and thereby cause a bill 14*a* to be removed from the stack 14 of bills as previously described. As a bill 14*a* is fed from the stack by the feed wheels 32 (FIG. 2), the bill thickness sensor 52 insures that only one bill 14*a* at a time is removed from the stack of bills 14 as previously described. As a single bill 14*a* passes the sensor 62 in the chute means 18, a signal is produced to indicate to the control logic 64 that the clutch/brake 38 should be placed in the brake mode until the bill 14*a* is deposited in one of the compartments 24, 26 of the container means 20. A second bill (not shown) extracted from stack of bills 14 is positioned between the feed wheel 32 and the thickness sensor 52 when the clutch/brake 38 is put into the brake mode at this time. The signal from sensor 62 also is used to advance a total counter 152 which records the total number of bills which have been fed in the chute means 18. Because the motor 34 continues to run, the pulleys 54 and 56 will advance a bill 14 in the chute means 18 at a rate of about 6 to 10 feet per second to the container means 20 where the first bill 14*a* will strike the first leg 72 of the selector means 22 and enter the first compartment 24 as previously explained. Upon entering the first compartment 24, the bill 14*a* will cause the first compartment sensor 114 to produce a signal which is fed to the control logic 64 to thereby energize a second winding 154 of the rotary solenoid 66 to cause the selector means 22 to be shifted through an angle of 30 degrees to the second position in which the second leg 74 thereof will be positioned in the path of the next successive bill 14 to approach the container means 20. The signal from the first compartment sensor 114 is also used to energize the clutch/-brake 38 to place it in the engaging or clutch mode and to record the first bill 14*a* entering the first compartment 24 on a first compartment counter 156. With the clutch/brake 38 in the clutch mode, the feed wheels 32 will feed the next successive bill 14*b* (not shown) into the chute means 18 where it is detected by the sensor 62. A signal from the sensor 62 causes the clutch/brake 38 to go into the brake mode to stop further feeding by the feed wheel 32 and also advances the total counter 152 by one. The motor 34 continues to drive the rollers 56, 58 and thereby feed the next bill 14*b* whereupon the leading edge of the next bill 14*b* abuts against the second leg 74 of the selector means 22, causing the second bill to enter the second compartment 26 as previously explained. As the second bill 14*b* enters the second compartment 26, a signal from the second compartment sensor 120 is fed to the control logic 64 which advances a second compartment counter 158 by one to count the bill 14*b* deposited in the second compartment, and also energizes the first winding 150 of the solenoid 66 to place the selector means 22 in the first position to enable the next successive bill 14*c* (not shown) to be fed into the first compartment 24. The logic 64 is set up so that signals coming from the first and second compartment sensors 114 and 120, respectively, must occur in an alternating pattern, i.e., 114-120-114-120 or the bill stacker 10 will be shut down. This insures that the bills 14 are alternately stacked in the first and second compartments 24-26-24-26, etc. When the control logic 64 verifies the signals from the sensors 114 and 120 as being in an alternating pattern, the control logic 64 then energizes the clutch/brake 38, placing it in the clutch mode to feed another bill to the chute means 18, causing it to be stacked in the second compartment 26 as previously explained. This process is repeated until all the bills 14 in the hopper means 12 are stacked in the container means 20. A check of the totals recorded on the first and second compartment counters 156, 158 should equal the total on the total counter 152 to verify that the bills 14 have been alternately stacked in the associated compartments 24, 26 of the container means 20. Because the control logic 64 may be conventional, it is not described in further detail.

While the bill stacker 10 has been described in relation to stacking single bills alternately in the compartments 24, 26 of the container means 20, it is apparent that the same techniques described herein can be used to alternately stack bundles of bills in the first and second compartments 24, 26. For example, the control logic 64 may be conventionally modified so as to cause any number of bills 14 to be stacked in the first compartment 24 of the container means 20, and then after logic confirmation as previously described, the second winding 154 of the rotary solenoid 66 is energized to cause the second leg 74 of the selector means 22 to be positioned in the path of the next successive bills to be stacked to cause them to be stacked in the second compartment 26 where an equal number of bills may be stacked. The process described is then repeated to produce alternating stacks of bills in the container means 20. Accordingly, the use of the term "bill" as used herein, also embraces a bundle of bills.

The bottom of the container means 20 may also have the necessary discharging structure therein (as disclosed in said patent) to enable the container means 20 to be used with the cash dispensing machine shown in said patent; however, because this structure is not a part of this invention, it is not shown herein.

What is claimed is:

1. An automatic bill stacker comprising:

hopper means for storing bills;

feed means for extracting a single bill from said hopper means;

a container means being cruciform in cross section and having first and second intersecting rectangular compartments therein, and also having an opening therein to enable bills to enter said compartments;

chute means for guiding a bill extracted from said hopper means in a feeding direction in a feed plane to said opening of said container means;

selector means moveable between first and second positions for engaging a leading edge of a bill moving in said feed plane causing it to rotate in one direction and enter said first compartment when said selector means is in said first position, and for causing said bill to rotate in a second direction opposite from said one direction and to enter said second compartment when said selector means is in said second position; and control means for controlling the operation of said feed means and said selector means so as to enable successive bills from said hopper means to be alternately deposited in said first and second compartments.

2. The stacker as claimed in claim 1 in which said control means has first and second sensors operatively associated with said first and second compartments to record the presence of a bill being deposited respectively in said first and second compartments, and in which said control means is effective to stop the operation of said bill stacker whenever successive bills being fed to said container means are not alternately deposited in said first and second compartments.

3. The bill stacker as claimed in claim 2 in which said selector means has drive means for moving said selector means between said first and second positions;

said first sensor, when recording the presence of a bill being deposited in said first compartment, being effective through said control means to energize said drive means and thereby move said selector means to said second position to enable the next successive bill being fed in said chute means to be deposited in said second compartment.

4. The bill stacker as claimed in claim 1 in which said selector means comprises a beam pivotally shiftable between first and second positions and having first and second legs depending from opposed ends of said beam, said first and second legs being alternately moved into said feed plane to engage the leading edge of a bill moving in said feed plane to enable successive bills to enter said first and second compartments, when said selector means is in said first and second positions, respectively.

5. The bill stacker as claimed in claim 4 in which said chute means is dimensioned to enable the length of a bill being fed therein to be substantially perpendicular to said feeding direction and to a common axis of the compartments in said container means, and said beam and first and second legs thereof are dimensioned to enable said first and second legs to engage opposed points of a leading edge of a bill with said points being located at approximately one-fifth of the length of a bill from the adjacent side thereof.

6. A method for stacking bills in a container means having an open end and having first and second compartments therein which are arranged at approximately 90 degrees to each other so that the first and alternate ones of successive bills are aligned in the first compartment and the second and alternate ones of successive bills are aligned in the second compartment, said bills when stacked in said first and second compartments having a common vertical axis, comprising the steps of:

a. feeding said bills in a feed plane towards said open end; and b. rotating each successive bill in said feed plane through an angle of rotation of approximately 45° in a direction opposite from the preceding bill to enable each successive bill to be alternately deposited in said first and second compartments;

said rotating step (b) being effected by the step (c) of alternately interposing first and second abutment members in the paths of successive bills being fed in said feed plane thereby contacting the leading edges thereof at opposed points located about one-fifth of the distance in from the associated leading edges as measured along the lengths of the bills, and causing said bills to rotate in said feed plane into said first and second compartments; and said feeding step (a) being effected by positioning said feed plane at an angle of approximately 80° relative to said vertical axis.

7. A method for automatically stacking bills in a container means having an open end and having first and second compartments therein in a predetermined angular relationship to each other so that the first and alternate ones of successive bills are aligned in the first compartment and the second and alternate ones of successive bills are aligned in the second compartment, comprising the steps of:

a. feeding a first bill in a feed plane towards said open end;

b. moving a first abutment member into the path of the leading edge of said first bill from step (a) causing said first bill to rotate in a first direction in said feed plane and to abut against a wall in said first compartment and enter said first compartment;

c. feeding a second bill in said feed plane towards said open end;

d. moving a second abutment member into the path of the leading edge of said second bill from step (c) causing said second bill to rotate in a second direction (opposite from said first direction) in said feed plane and to abut against a wall in said second compartment and enter said second compartment;

e. alternating the movement of said first and second abutment members into the paths of successive bills being fed in said feed plane so as to enable successive bills to be alternately fed into said first and second compartments, respectively;

f. monitoring the feeding of bills in said first and second compartments to insure that said bills are alternately fed into said first and second compartments; and g. counting the bills placed in each of said first and second compartments and comparing the counts in each compartment with the total count of bills which have been fed in said feed plane.

* * * * *